US005802775A

United States Patent [19]

Toth

[11] Patent Number: 5,802,775

[45] Date of Patent: Sep. 8, 1998

[54] ACTIVE GUTTER DOWNSPOUT STRAINER WITH ROTATING ACTION

[76] Inventor: Brian R Toth, 110 N. Webster St. #5, Naperville, Ill. 60540

[21] Appl. No.: 780,191

[22] Filed: Dec. 26, 1996

[51] Int. Cl.[6] ..... E04D 13/00

[52] U.S. Cl. ..... 52/12; 52/16; 210/163

[58] Field of Search ..... 52/11, 12, 16; 210/163, 164, 459, 460

[56] References Cited

U.S. PATENT DOCUMENTS

| | | | |
|---|---|---|---|
| 2,121,613 | 6/1938 | Schultz | 210/163 |
| 3,828,931 | 8/1974 | Henricksen | 210/163 |
| 4,216,790 | 8/1980 | Stoltz | 52/12 X |
| 4,241,547 | 12/1980 | Bove | 52/11 |
| 4,669,232 | 6/1987 | Wyatt | 52/12 X |
| 4,807,406 | 2/1989 | Densmore | 52/12 X |
| 4,837,987 | 6/1989 | Fender | 52/11 |
| 4,852,308 | 8/1989 | Papenbrock et al. | 52/12 |
| 5,220,755 | 6/1993 | Roles | 52/16 |
| 5,302,283 | 4/1994 | Menche | 52/12 X |
| 5,335,460 | 8/1994 | Smith, Jr. | 52/11 |
| 5,409,602 | 4/1995 | Sorenson | 52/12 X |
| 5,618,416 | 4/1997 | Haefner | 210/163 |

*Primary Examiner*—Wynn Wood Coggins

[57] ABSTRACT

A flexible cage is attached to a base which fits in to a gutter downspout opening. A cord is attached at the top center of the flexible cage and it extends through the cage and out of the downspout. The construction of the cage is a hub and spoke system, primarily to be manufactured of plastic. The round spokes are attached to a central hub, the base is fixed and rests in the drain opening, and the legs of the cage to attached to the base. When the cage is not in its active phase, its function is passive, preventing debris from clogging the drain opening. When in operation, via the actuating cord, the design and construction of the cage, along with force applied by pulling the cord, causes the cage to compress and rotate around the drain opening. The action of the device around the drain opening loosens debris and creates openings which allow water to flow freely again. When tension is released from the cord, the strainer rotates back to its original position and shape, and returns to its passive function as a strainer.

3 Claims, 4 Drawing Sheets

ACTIVE GUTTER DOWNSPOUT STRAINER WITH ROTATING ACTION

CROSS REFERENCES TO RELATED APPLICATIONS

1. This invention is an improvement on U.S. Pat. No. 5,302,283 (Meuche 1994) Leaf Gaurd and Strainer.

1. Background—Field of Invention

This invention relates to roofing gutters, specifically maintaining the flow of water at the drain and downspout area.

2. Background—Description of Prior Art

A roofing gutter system is comprised of a gutter system which runs the length of the roof, and a drain, or drains, that allow water to be collected from the roof to be routed down, and away from the structure. Roof drainage systems are designed to be passive, using gravity and angled gutters to direct the flow of water.

Problems arise when debris falls in to the gutter system and move to the drain opening. The debris collects around, and over the drain, and inhibits drainage. Systems have been designed to prevent debris from entering the gutter. Some examples are screens that run the length of the gutter and over the gutter, and passive rigid cages that fit in to the drain opening. With both systems, debris can find its way to the drain area and cause a backup of water. When a gutter system fails, or is inhibited, water is not allowed to flow through the system properly. When the system does not work as it is designed, rainwater can flow over the gutters. When water falls near the structure, the water can enter the structure. When water remains in the gutter system, weight can cause stress on the system and structure. Standing water can accelerate corrosion on metal systems and shorten its lifespan. Standing water can also create a health hazard by providing a breeding ground for many types of bugs such as mosquitos. Standing water can often support plant growth, again accelerating the deterioration of the gutter system and structure.

A drain cage, or strainer, shown in U.S. Pat. No. 5,302,283 (Meuche 1994), A leaf guard and strainer assembly shows a rigid cage inserted in to the spout of the opening to trap leaves. The disadvantage of this type of a passive system is that once leaves are stopped by the cage, water can not easily reach the drain. Often the strainer can completely block the flow of water. Once the flow is reduced enough, or stopped, the strainer needs to be removed and the drain cleaned.

U.S. Pat. No. 3,121,684 (Bugbird 1964), describes a bulbus strainer that is rigid in design, and assisted in to its position by use of a flexible cord. The disadvantage of this system is that it merely assists a strainer in to position.

OBJECTS AND ADVANTAGES

Accordingly, several objects and advantages of my invention are to provide a flexible cage that rests above the drain, and can be selectively controlled from a remote location. The action of the strainer can improve drainage of the gutter system, and is easy to install. For the user, the strainer allows improved drainage, ease of use, and economy. The strainer also gives the user the advantage of remote operation from the ground, and that eliminates the need for climbing a ladder to clean the drain area. The strainer can be easily manufactured of plastic, nylon, or flexible wire. Previous approaches to the problem of gutter drain maintenance employ a passive solution.

Still further objects and advantages will become apparent from a consideration of the ensuing description and accompanying drawings.

SUMMARY

A flexible cage, attached to a base. The flexible cage constructed in a manner such that when force is applied, it will respond in a predetermined manner. The base holds the strainer above the drain opening. A device attached to the cage, and extended to ground level is used to operate the active feature of the strainer.

PREFERRED EMBODIMENT—DESCRIPTION

Figure 1:
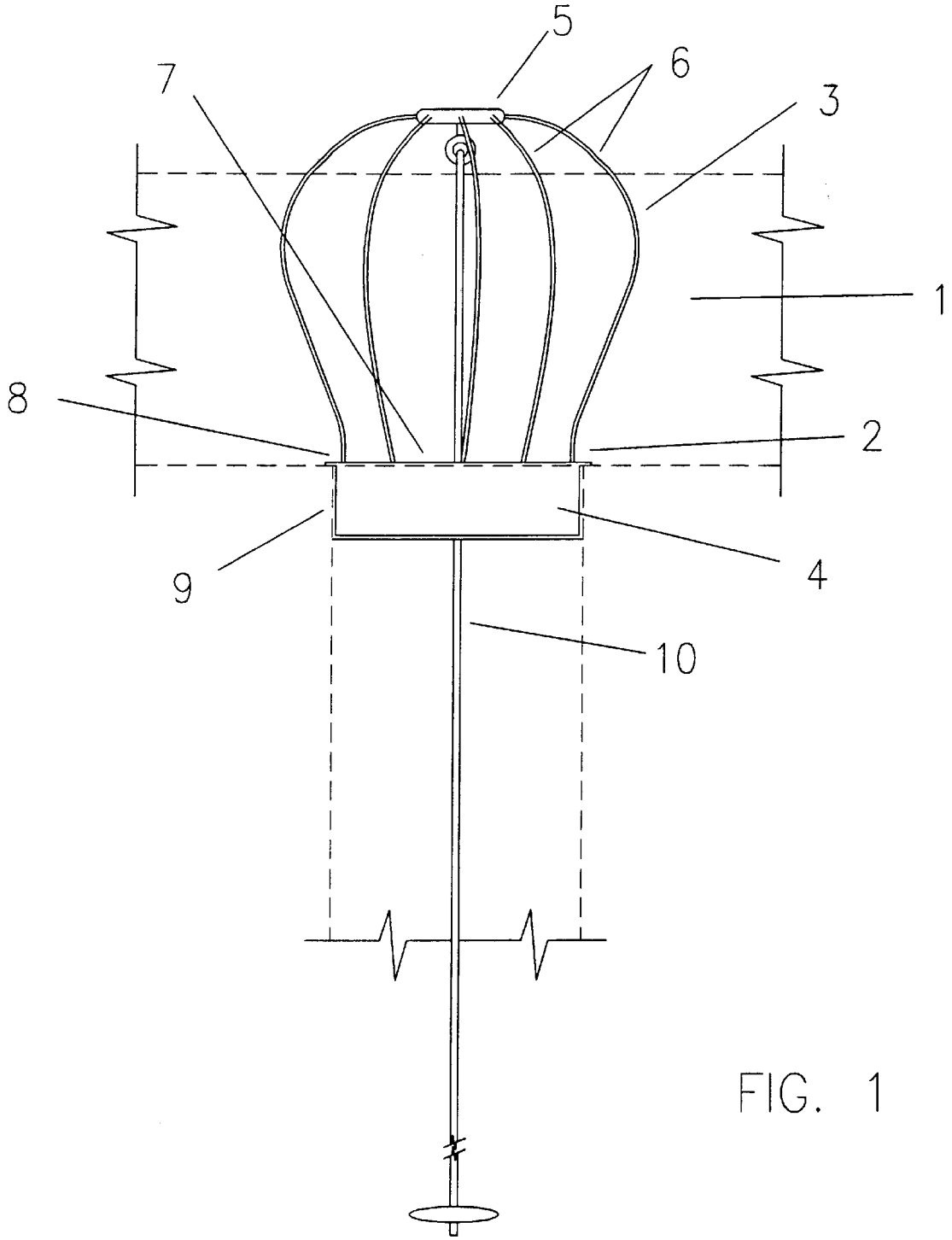
FIG. 1 is a side cutaway view of the strainer in position in the gutter system with the actuating cord attached.

FIG. 1 is a side cut away view of the strainer assembly (1) in place over a gutter drain or downspout opening (2). The drawing shows the strainer assembly flexible cage structure (3) attached to a base plate (4) which sits in the gutter drain opening. The flexible cage comprises a top hub (5) and a plurality of flexible members or spokes (6), the flexible members having a first end attached to the top hub and a second end attached to the base plate, the base plate having a center opening (7) and inverted L-shaped stops each having a top edge (8) and a depending leg (9). Each top edge of the base plate stop lying in contact with the gutter bottom and each depending leg fitting inside the downspout opening and positioned adjacent the inner walls of the downspout opening. An actuating cord (10) is attached to the bottom center of the top hub and extends downwardly through the downspout opening. The flexible cage fits between the two opposing walls of a gutter. This is the position the strainer is in when there is no force applied to the actuating cord. The actuating cord is run from the top-center of the cage, and down the drain hole, through the entire downspout. There is enough of the cord out the end of the downspout to allow the operator to grasp the cord.

Figure 2:
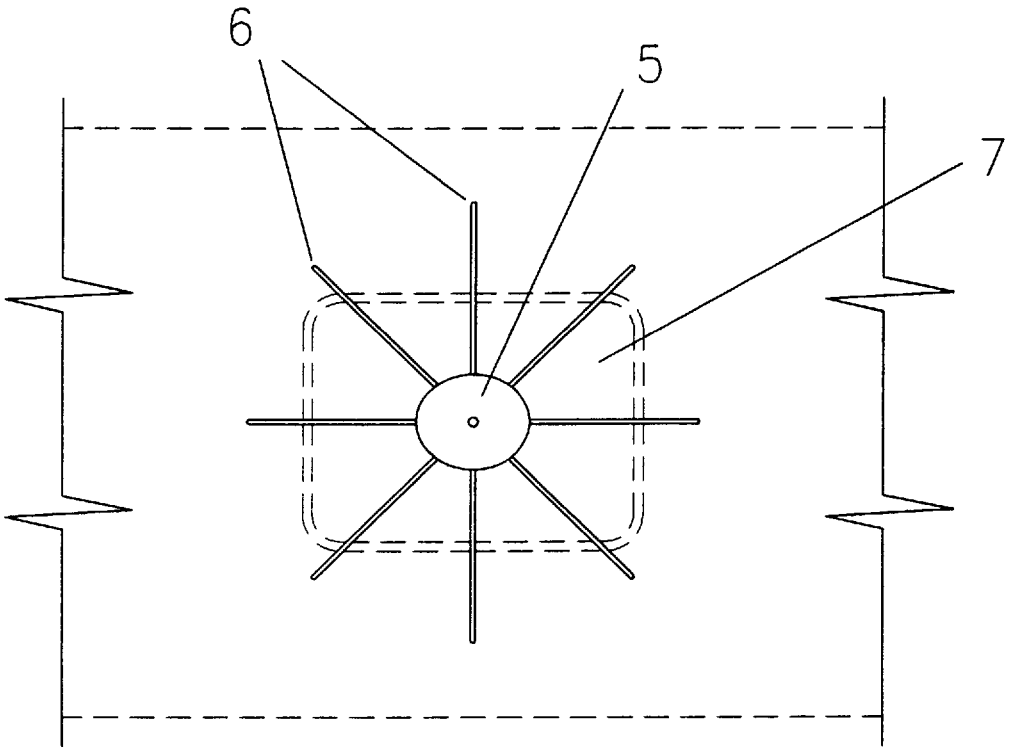
FIG. 2 is a top view of the strainer in its passive position. The base is in the drain opening, and the cage is shown in position between the gutter walls.

FIG. 2 is a top view of the strainer in position in the gutter drain. This view shows the hub and spoke design of the flexible cage. The middle of the hub is where the actuating cord is attached.

Figure 3:
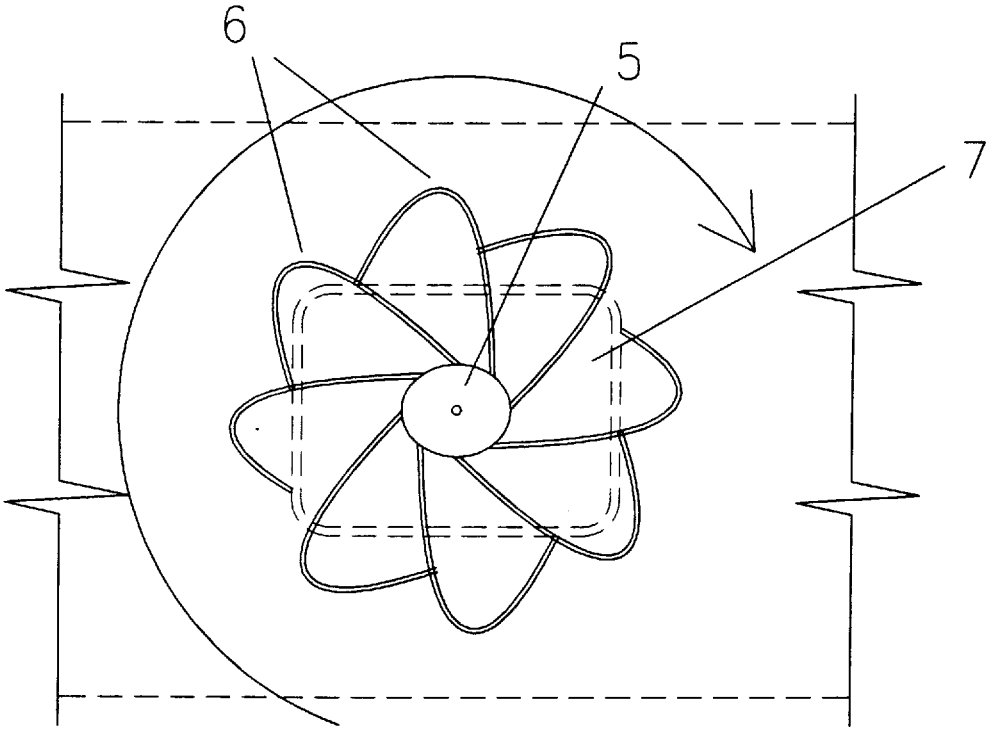
FIG. 3 is a top view of the strainer in position when compressed, or fully actuated.

FIG. 3 is a top view of the strainer when the actuating cord is pulled from below. The draw of the cord pulls the hub down, which causes torsion on the spokes. Torsion on the spokes, and the pull on the cord causes the cage to compress, and rotate around to a flat position as shown.

Figure 4:
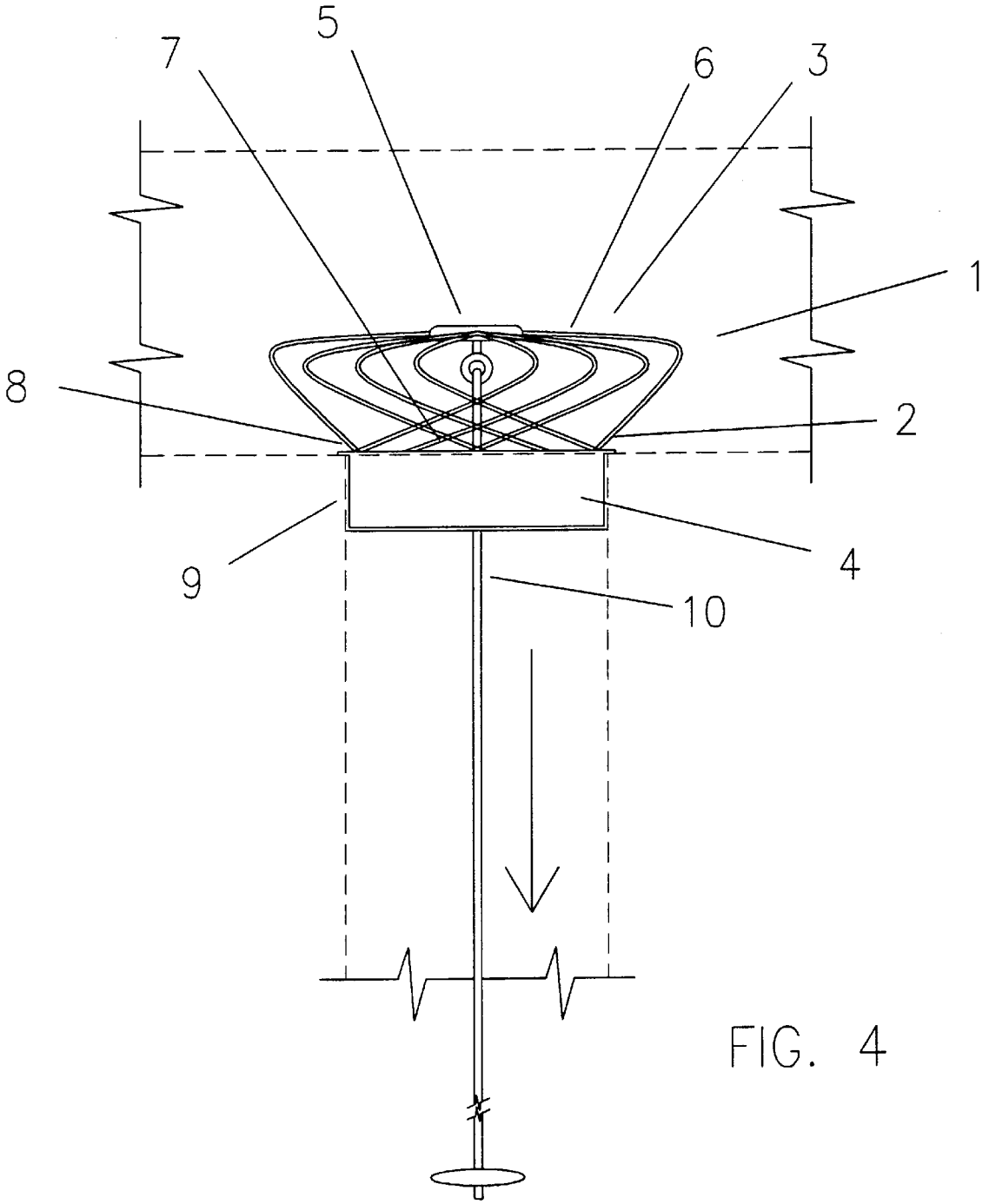
FIG. 4 is a side view of the strainer fully compressed, or actuated. The arrow pointing down shows the direction of pull on the actuating cord needed to initiate the active feature.

FIG. 4 is a side view of the strainer when it is fully compressed. The strainer lays nearly flat against the gutter drain. When the actuating cord is released, the strainer will return to its original shape and position, as seen in FIG. 1.

PREFERRED EMBODIMENT—OPERATION

FIG. 1 shows the strainer in position in the gutter system. To initiate operation of the active feature, the user gives a slight pull on the end of the actuating cord which is located at the end of the down spout. As the strainer is compressed, the design of the strainer causes the strainer to compress with rotating action (FIGS. 3 & 4), and debris around the drain is loosened. When the tension is let off of the cord, the strainer returns to its original shape and position. Repeated cycles of this operation will allow standing water to flow again, carrying some of the debris with the water down the drain. Once the user is finished activating the strainer, the strainer is in its original position (FIG. 1), and its function is passive, preventing the drain from clogging.

The strainer is not designed to eliminate maintenance of the gutter system, but is designed to assist in maintaining flowage. Obvious advantages include reducing stress on the system by reducing, or eliminating standing water, and reducing the number of times an individual needs to have the system serviced.

CONCLUSIONS, RAMIFICATIONS, AND SCOPE

Accordingly, it can be seen that the flexible cage can be selectively controlled and assist in keeping the drain area free of debris. The user of the strainer can operate the strainer remotely, from ground level, eliminating trips up a ladder to clean the drain, or hiring someone to service the gutter system. The strainer can be economically manufactured from a variety of common materials.

Although the description above contains many specificities, these should not be construed as limiting the scope of the invention but as merely providing illustrations of some of the presently preferred embodiments of this invention. Various other embodiments and ramifications are possible within it's scope. Thus the scope of the invention should be determined by the appended claims and their legal equivalents, rather than by the examples given.

I claim:

1. A flexible strainer to be attached to roofing gutter downspout drain openings comprising:

A flexible cage constructed of inverted U shaped members attached to a base plate, said flexible cage to fit within the space defined by the walls of the gutter, A Fixed base plate adapted to fit within the drain opening without obstructing the drain opening, said base plate to rest flush against the sides of the drain opening, said base plate having inverted L shaped stops which rest against the gutter floor to prevent the base from falling in to the gutter drain, A cord attached to the top center of said cage, said cord extending through the drain opening and out to the opening of the down spout.

2. Said flexible cage in claim 1, when in operation initiated by force via said cord, compresses said cage, Said cage compresses in a manner which is predetermined by the shape and construction of cage described in claim 1, simultaneously rotating above the space defined by the drain opening, and within the space defined by the walls of the gutter, Said cage, returns to its original position and shape when force from said cord is stopped.

3. A flexible strainer to be attached to roofing gutter downspout drain openings comprising:

A flexible cage constructed of U shaped members, attached to a base plate, said flexible cage to fit within the space defined by the walls of the gutter, A fixed base plate adapted to fit within the drain opening without obstructing the drain opening, said base plate to rest flush against the sides of the drain opening, said base plate having inverted L shaped stops which rest against the floor of the gutter to prevent the base from falling in to the gutter drain, A cord attached to the top center of said cage, said cord extending through the drain opening and out to the opening of the down spout, Said flexible cage when in operation by force via said cord, compresses said cage, Said cage compresses in a manner which is predetermined by the shape and construction of said cage, simultaneously rotating above the space defined by the drain opening, and within the space defined by the walls of the gutter, Said cage returns to its original position and shape when force from said cord is stopped, Said cage prevents debris from clogging the drain opening, operation of the described strainer via said cord displaces debris collected by the strainer cage around the drain opening, and creates openings which allows water collected in the gutter to flow through the cage and in to the drain opening.

* * * * *